US005142276A

United States Patent [19]

Moffat

[11] Patent Number: 5,142,276

[45] Date of Patent: Aug. 25, 1992

[54] METHOD AND APPARATUS FOR ARRANGING ACCESS OF VRAM TO PROVIDE ACCELERATED WRITING OF VERTICAL LINES TO AN OUTPUT DISPLAY

[75] Inventor: Guy Moffat, Palo Alto, Calif.

[73] Assignee: Sun Microsystems, Inc., Mountain View, Calif.

[21] Appl. No.: 632,040

[22] Filed: Dec. 21, 1990

[51] Int. Cl.[5] ..... G09G 1/02

[52] U.S. Cl. ..... 340/799; 340/750; 340/798

[58] Field of Search ..... 340/799, 798, 747, 703, 340/750

[56] References Cited

U.S. PATENT DOCUMENTS

| | | | |
|---|---|---|---|
| 4,192,961 | 2/1981 | Petersen | 340/747 |
| 4,236,228 | 11/1980 | Nagashima et al. | 340/799 |
| 4,745,407 | 5/1988 | Costello | 340/799 |
| 4,748,442 | 5/1988 | Allaire | 340/703 |

*Primary Examiner*—Alvin E. Oberley
*Assistant Examiner*—Regina Liang
*Attorney, Agent, or Firm*—Blakely Sokoloff Taylor & Zafman

[57] ABSTRACT

An arrangement for writing to and reading from the random access ports of a multibank frame buffer so that individual pixels to be presented in a vertical line on an output display are arranged sequentially from top to bottom in different banks of the frame buffer.

18 Claims, 4 Drawing Sheets

SWAPPER TRUTH TABLE

| Y1 | Y0 | S1 | S0 | A | B | C | D |
|---|---|---|---|---|---|---|---|
| 0 | 0 | 0 | 0 | D0 | D1 | D2 | D3 |
| 0 | 1 | 1 | 0 | D2 | D3 | D0 | D1 |
| 1 | 0 | 0 | 1 | D1 | D0 | D3 | D2 |
| 1 | 1 | 1 | 1 | D3 | D2 | D1 | D0 |

METHOD AND APPARATUS FOR ARRANGING ACCESS OF VRAM TO PROVIDE ACCELERATED WRITING OF VERTICAL LINES TO AN OUTPUT DISPLAY

BACKGROUND OF THE INVENTION

1. Field of the Invention

This invention relates to computer systems and, more particularly, to methods and apparatus for accessing frame buffers used in providing output signals to output displays so that vertical lines are described rapidly.

2. History of the Prior Art

Computer systems use a buffer memory called a frame buffer for storing data which is to be written to an output display. The information in the frame buffer is written to the display line-by-line generally beginning at the upper lefthand corner of the display and continuing to the lower right-hand corner. One frame of information is followed by the next so that, as the picture in one frame charges to the picture in the next, continuous motion is presented.

Typically, a frame buffer is constructed of video random access memory (VRAM) which differs from conventional random access memory by having a first random access port at which the frame buffer may be read or written and a second line-at-a-time serial output port through which pixel data is furnished to the circuitry controlling the output display. Such a construction allows information to be written to the frame buffer while the frame buffer continually furnishes information to the output display.

One physical arrangement used for frame buffers arranges a number of banks of VRAMs so that a first pixel of a horizontal line which is to be dislayed is stored in a first VRAM bank, a second pixel on the line is stored in a second VRAM bank, a third pixel on the line is stored in a third VRAM bank, and so on through the last VRAM bank. Then the pixel storage starts over at the first of the VRAM banks. This arrangement allows very rapid writing of pixels describing a single horizontal line because a number of pixels may be written to the frame buffer together. Moreover, page mode addressing which allows more rapid addressing within a page of memory than typical random access of the frame buffer enhances this effect for horizontal lines.

However, the drawing of vertical lines on a display suffers drastically using the typical multiple banks frame buffer just described. This occurs because drawing a vertical line requires that the same VRAM bank of a frame buffer be used for each pixel of the line. Consequently, pixel accesses in the same VRAM bank must be addressed sequentially through the random access ports to describe the line. Since the same bank is being addressed to write to the frame buffer, there has been no way to make the accesses in parallel or to cause those accesses to overlap. The use of page mode accessing does not speed up the addressing of pixels describing vertical lines since the size of a page is typically only about a line or two of the display.

Drawing vertical lines has become more important recently with the advent of the various screen control programs which display a plurality of different application programs in a plurality of windows on the display. The number of vertical lines used by these screen programs makes the time required for their drawing less than trivial. It would, therefore, be advantageous to be able to accelerate the operation of drawing vertical lines on the output display of a computer system.

SUMMARY OF THE INVENTION

It is, therefore, an object of the present invention to speed the operation of drawing vertical lines and non-horizontal lines on the output display of a computer system without sacrificing horizontal line drawing speed.

It is another more specific object of the present invention to provide an improved method and apparatus for accessing frame buffers to allow vertical lines to be drawn more rapidly on the output display.

These and other objects of the present invention are realized in an arrangement for writing to and reading from the random access ports of a frame buffer so that individual pixels to be presented to describe a vertical line on an output display are arranged sequentially from top to bottom in different banks of the frame buffer so that the accesses to the frame buffer may be overlapped.

These and other objects and features of the invention will be better understood by reference to the detailed description which follows taken together with the drawings in which like elements are referred to by like designations throughout the several views.

NOTATION AND NOMENCLATURE

Figure 2:
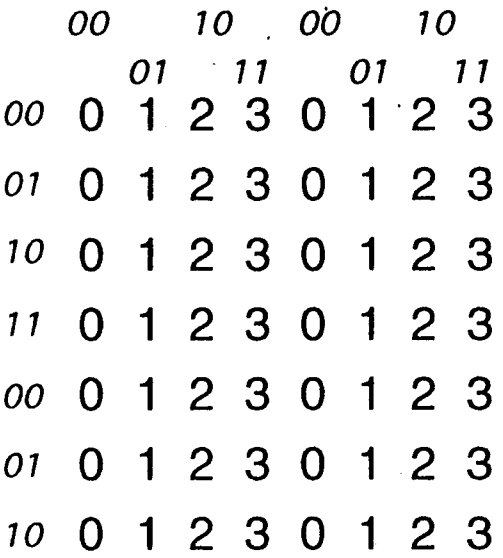
Figure 2 (Prior Art)
FIG. 2 is a diagram illustrating the pattern in which VRAMs are selected to present pixels in a typical arrangement in accordance with the prior art.

Some portions of the detailed descriptions which follows are presented in terms of symbolic representations of operations on data bits within a computer memory. These descriptions and representations are the means used by those skilled in the data processing arts to most effectively convey the substance of their work to others skilled in the art. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most cases in any of the operations described herein which form part of the present invention; the operations are machine operations. Useful machines for performing the operations of the present invention include general purpose digital computers or other similar devices. In all cases the distinction between the method operations in operating a computer and the method of computation itself should be borne in mind. The present invention relates to apparatus and to method steps for operating a computer in processing electrical or other (e.g. mechanical, chemical) physical signals to generate other desired physical signals.

DETAILED DESCRIPTION OF THE INVENTION

As described above, one physical design used for frame buffer memories arranges a number of banks of video random access memories so that a first pixel on a horiztonal line to be displayed is stored in a first bank of video random access memory (VRAM), a second pixel in a second VRAM bank, a third pixel in a third VRAM bank, and so on through the last VRAM bank. The arrangement allows very rapid writing of pixels describing a single horizontal line on an output display but the drawing of vertical lines on a display suffers drastically. This occurs because drawing a vertical line requires that the same bank of a frame buffer be addressed sequentially using random access addressing for each sequential pixel of the line. Since the same is being addressed through sequential accesses to the frame buffer, there has been no way to make the accesses overlap.

Figure 1:
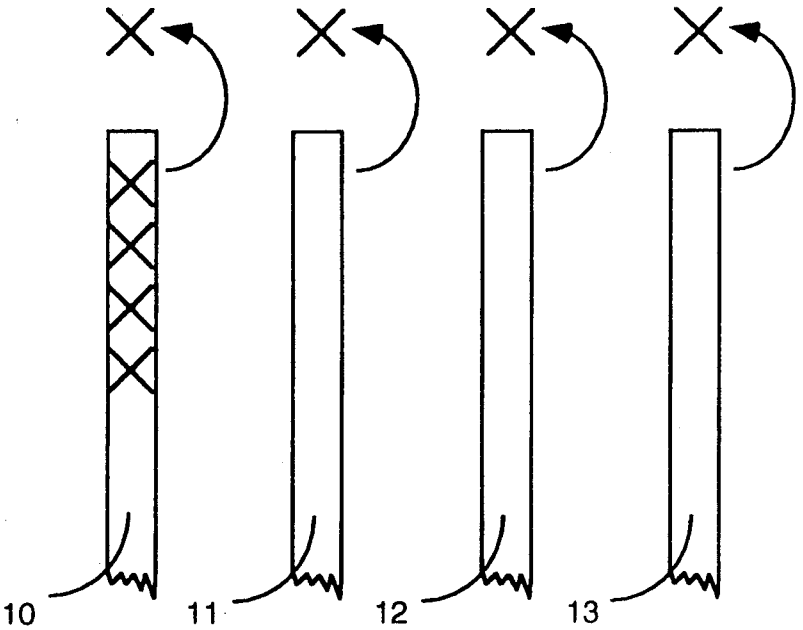
FIG. 1 is a diagram illustrating the arrangement of individual VRAMs in a frame buffer associated with an display.
Figure 3:
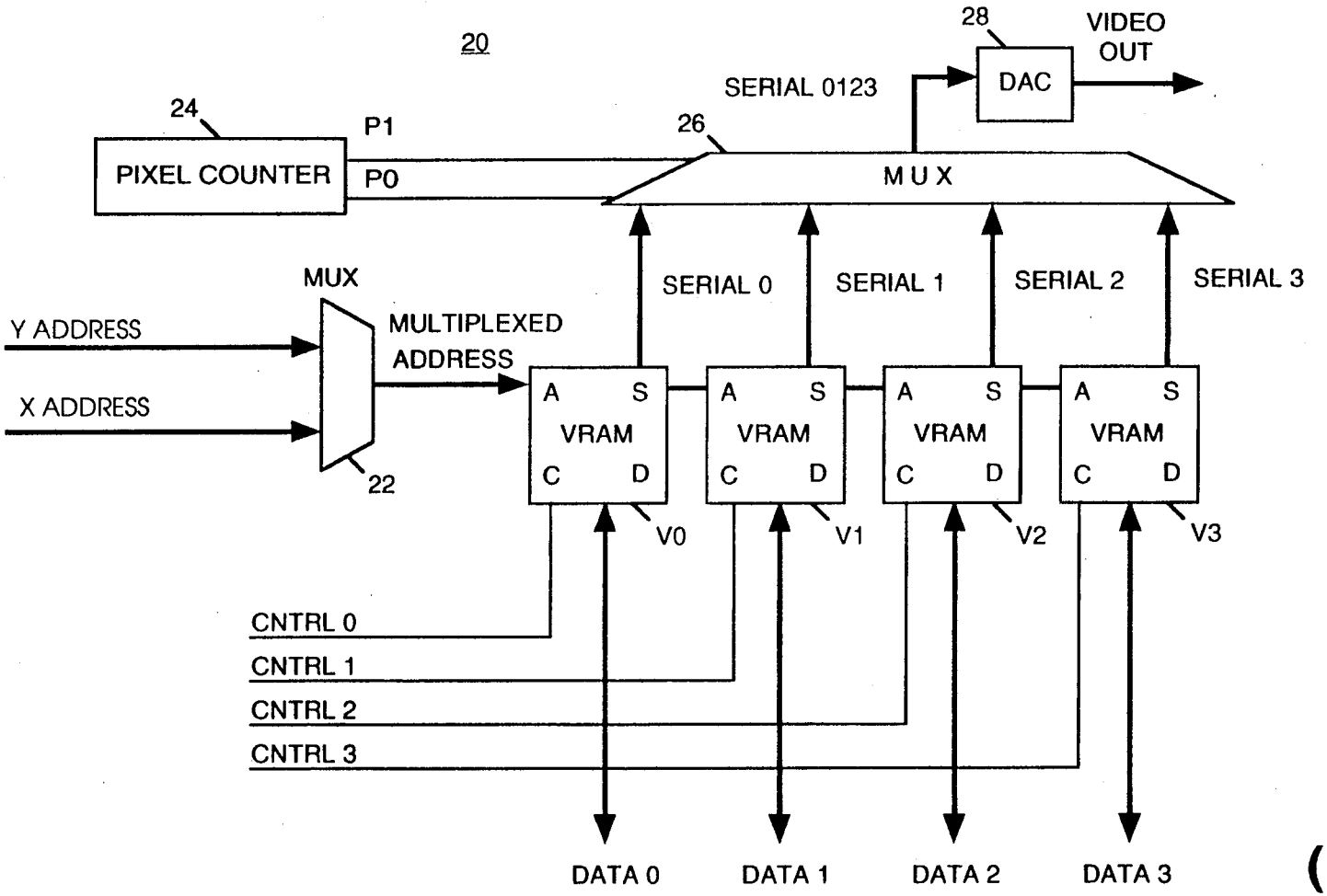
Figure 3 (Prior Art)
FIG. 3 is a block diagram illustrating a circuit for controlling access to VRAMs in a frame buffer of the prior art.

FIG. 1 is a diagram illustrating an arrangement of individual VRAMs in a frame buffer associated with an output display. As illustrated in FIG. 3, which shows a typical prior art frame buffer, four individual VRAMs V0–V3 are physically arranged so that they provide pixels for display. Each of the banks of VRAMs holds one of the pixels in a sequence of four pixels in a horizontal line. In FIG. 1, each pixel provided by a bank of VRAM is illustrated in a position on an abbreviated horizontal line at which it might appear on the display. Because of the typical addressing scheme of the prior art which will be discussed in detail below, the access of the VRAMs, both for reading and for writing a horizontal line using the random access ports may occur to a great extent in parallel and therefore very rapidly.

When, however, a vertical line is being described, the time for accessing the frame buffer increase drastically. This may be understood by viewing the first four pixel positions in the left hand column of the VRAM bank V0 of FIG. 1.

As may be seen from the four "X" symbols in bank 10 which represent the pixels in a short vertical line, each position which stores these first four pixels is stored in the same bank 10 of the frame buffer. Consequently, to describe a vertical line, the VRAM bank V0 must be accessed through the random access port of the frame buffer four individual times in sequence for writing the four pixels. Since these pixels are in the same VRAM bank 10 of the frame buffer, the accesses cannot be overlapped. For this reason, the drawing of a vertical line takes a significantly greater amount of time than does the access of the frame buffer to describe a horizontal line.

FIG. 2 illustrates a repeating pattern of pixels held in a typical frame buffer having four individual video random access memory banks arranged as described in FIG. 1. As may be seen, the pixel pattern 0, 1, 2, 3 illustrates the sequence of VRAM banks in which the pixels in lines to be displayed are stored. Each of the pixels in sequence describing a horizontal line may be seen to be stored in a repeating sequence of VRAM banks. On the other hand, the pixels describing any vertical line are all stored in the same VRAM bank. It is worth noting at this point that any diagonal line will be described by a series of pixels which are stored in different VRAM banks of such a frame buffer. However, the typical number of diagonal lines which are presented are significantly less than the number of vertical lines so it is the vertical line presentation which slows the drawing to the display.

FIG. 3 is a block diagram illustrating a circuit 20 for controlling access to VRAM banks in a frame buffer of the prior art which will better illustrate why horizontal lines may be described more rapidly than may vertical lines. The circuit 20 includes four banks of VRAMs individually labelled as V0 through V3. X and Y addresses are provided through a multiplexor 22 (which indicates, in general, the random accessing circuitry for addressing the frame buffer). The multiplexed address is furnished to all of the individual banks of VRAMs V0–V3. All of these banks have the same address for four individual pixels in a horizontal line in the sequence 0, 1, 2, 3 illustrated in FIG. 2. As the individual pixels are furnished on the data lines DATA 0 through DATA 3, control signals CNTRL 0 through CNTRL 3 select the particular bank of VRAM to which the pixel is to be written. If the pixel information is available simultaneously on all of the data lines, then it may be written to the four VRAM positions on a horizontal line simultaneously. This is obviously a very rapid operation. In like manner, the information describing a horizontal line may be read out of the random access ports is the same rapid manner.

In order to provide pixels for display, a pixel counter 24 furnishes select signals P0 and P1 to a multiplexor 26. The multiplexor 26 receives pixels simultaneously from the four VRAM banks for the particular four pixel horizontal segment of a line described above. The signals P0 and P1 from the pixel counter 24 cause the multiplexor 26 to select the pixels in sequential order for transfer to a digital-to-analog converter circuit 28 and then on for ultimate display, all in a manner well known to the prior art.

When writing to the frame buffer 20 of FIG. 3 to describe a vertical line, on the other hand, each pixel position must be individually addressed because the pixel positions all lie in the same VRAM bank. Thus, the availability of data on the four data lines DATA 0–3 simultaneously does not hasten the writing of a vertical line to the frame buffer because only one bank of VRAM is being written to. Reading information describing a vertical line through the random access ports of such a frame buffer 20 occurs in substantially the same manner since the same facilities are used. Consequently, the accessing of information describing a vertical line through the random access ports in such a frame buffer 20 is very slow relative to the accessing time required for describing a horizontal line.

Figure 4:
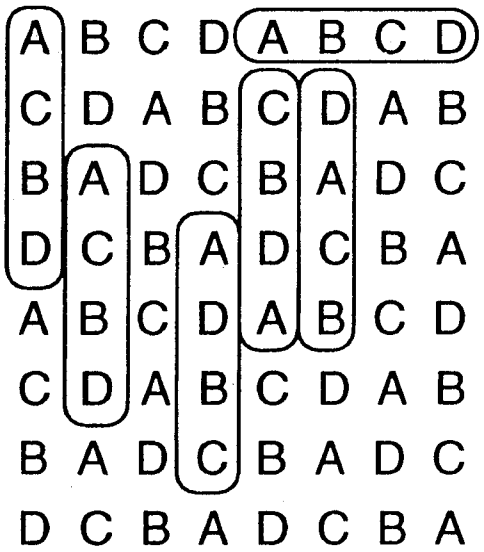
FIG. 4 is a diagram illustrating a pattern in which VRAMs are selected to present pixels in an arrangement in accordance with the present invention.

FIG. 4 is a diagram illustrating a pattern in which pixel information may be stored in the VRAM banks which make up a frame buffer in accordance with the present invention. Using this pattern, information describing vertical lines may be stored in the VRAM banks much more rapidly than in the arrangement of FIG. 3. In the diagram, the letter A is used to indicate a pixel stored in a first VRAM bank, the letter B is used to indicate a pixel stored in a second VRAM bank, the letter C is used to indicate a pixel stored in a third VRAM bank, and the letter D is used to indicate a pixel stored in a fourth VRAM bank.

As may be seen from the pattern, the pixels in a horizontal line to be presented on the output display are stored in the same sequential order as in the above described prior art arrangement except that certain lines commence with different pixels. However, the pixels which describe a vertical line lie in an entirely different pattern than in the prior art arrangement. In fact, the pixels which describe a vertical line lie in an order in which each of the pixels in a four pixel sequence lies in a different VRAM bank. This is true of any four pixels in a vertical sequence as may be seen from the lines encircling a number of such sequences in FIG. 4.

Since none of the pixels in a vertical sequence of four pixels fall in the same VRAM bank, the accesses of the frame buffer through the random access ports for a write to the frame buffer or a read from the buffer may be overlapped to speed those operations and the operation of describing a vertical line on the display.

Figure 5:
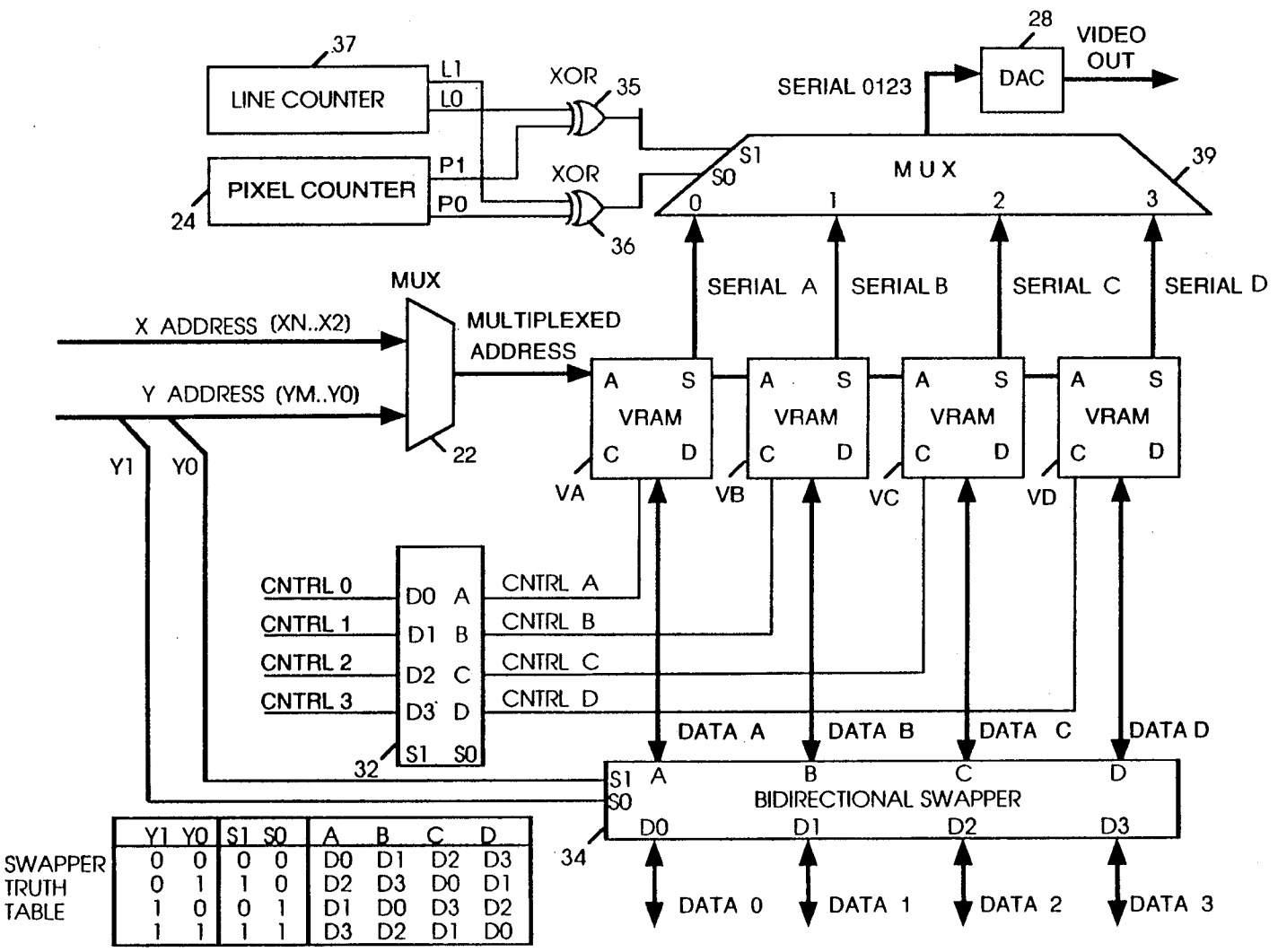
FIG. 5 is a block diagram illustrating a circuit for controlling access to VRAMs in a frame buffer in accordance with the present invnetion.

Providing a frame buffer storage pattern as in FIG. 4 in which no pixel in a vertical line lies adjacent another pixel in the line stored in the same VRAM bank may be accomplished by circuitry which reviews the number of a line in which pixels are stored and realigns those pixels depending upon the line number. FIG. 5 is a block diagram illustrating a circuit 30 for controlling access to VRAM banks in a frame buffer in order to obtain the benefits of the present invention. As may be seen, FIG. 5 includes circuitry in addition to that included in FIG. 3. This circuitry is utilized in order to access the correct addresses in the frame buffer to store the pixel information in accordance with the diagram of FIG. 4, to read that pixel information from the frame buffer through the random access port, and to write the information to the display. It should be noted at this point that although the circuit 30 describes only four individual VRAM banks (here referred to as VA, VB, VC, VD) in the frame buffer circuit 30 of FIG. 5 and in the pattern of FIG. 4, a different number of VRAM banks might be employed. For example, eight banks of VRAM might be used in a frame buffer to provide more rapid access. The details of such an arrangement, however, are felt to outweigh the benefits of understanding provided so only four banks are illustrated in this description. Those skilled in the art will understand how to modify the circuitry to extend the number of VRAM banks.

The circuit 30 of FIG. 5 includes in addition to that illustrated in the circuit of FIG. 3, a gating circuit 32 for swapping the normal control signals CNTRL 0 through CNTRL 3 to enable the appropriate VRAM bank so that data describing a particular pixel may be stored in a VRAM bank of the frame buffer 30. The circuit 30 also includes a bidirectional swapping circuit 34 of gates for directing data to or from the appropriate VRAM banks to provide the storage pattern described in FIG. 4. In addition to these circuits used for providing access at the random access ports of the circuit 30, a first pair of XOR gates 35 and 36 and a line counter circuit 37 are used to enable a multiplexor 39 so that the data describing the pixels being sent to the display may be restored to its original order.

The operation of the circuit 30 in providing storage for pixels in accordance with the pattern described in FIG. 4 will now be described. To write to the frame buffer, the X and Y addresses of the pixels are furnished on the X and Y address lines. It should be noted that the X addresses are all the same for each of four adjacent pixel positions while the Y addresses increment by one with each line. This occurs because in the system of the preferred embodiment, four pixels values of eight bits may be transferred in a thirty-two bit word. Four sequential eight bit pixels may be formed from such a word each having the same X address. The two lowest order digits of the Y addresses forming the pattern illustrated in FIG. 2 are shown to the left of that pattern.

The addresses furnished are the addresses which are furnished in a typical system and are the addresses furnished on the X and Y address lines in the circuit 30 of the present invention. In addition, the data furnished to describe the pixels at each position appears at the DATA 0 through DATA 3 data lines in the same order as in the prior art circuit 20. These four pixel values may appear in a single data word and be addressed to adjacent pixel positions. To accomplish this, they are separated into eight bit groups which are placed on the four adjacent data lines DATA 0–3. In this manner, the four pixels may be stored simultaneously as described above.

The addresses would normally place pixel data at positions at the intersection of any two such addresses as in the pattern of FIG. 2. However, unlike the circuit 20 of FIG. 3, the circuit 30 places that data not at the expected intersections of the addresses but in the pattern illustrated in FIG. 4. To accomplish this, the lowest two bits of the Y address are used to actuate the swapper circuits 32 and 34. Using the Y address values shown, it may be seen that in the first line all Y addresses end in 00 binary. Consequently, the values at the select terminals S0 and S1 of the swapper circuits 32 and 34 transfer the values illustrated in the truth table in FIG. 5. In reading the table, the Y0 and Y1 values for each vertical line are shown to the left. Immediately to the right are shown the select values provided to the select terminals of the swapper circuits 32 and 34. To the right are shown the data terminals on which input signals appear, and above each data terminal is shown the enable signal generated and thus, in effect, the bank to which the data is directed.

Thus, for a four pixel horizontal line starting at address 00, 00, the truth table of FIG. 5 shows that the first pixel selected appears on DATA 0 and the first control signal A sends that pixel to VRAM bank A. The second pixel selected appears on DATA 1 and the second control signal B sends that pixel to VRAM bank B. The third pixel selected appears on DATA 2 and the third control signal C sends that pixel to VRAM bank C. The fourth pixel selected appears on DATA 3 and the fourth control signal D sends that pixel to VRAM bank D. Since these pixel data values appear simultaneously in a single data word, they are all stored in the four banks of VRAM simultaneously. Thus, the four pixels of the horizontal line are placed in their standard sequential order.

However, the lowest order bits of the Y address values for any vertical column vary in a pattern of 0101 for Y0 and 0011 for Y1 as a vertical line moves down from address 00,00. Thus, it may be seen that the values produced selected by the two lower digits of the Y addresses for pixels in the first vertical column will vary as a vertical line moves down from address 00,00. Thus for a four pixel vertical line starting at address 00, 00, the truth table of FIG. 5 illustrates that the first pixel selected appears on DATA 0 and the first control signal A sends that pixel to VRAM bank VA. The second pixel selected appears on DATA 0 and the second control signal C sends that pixel to VRAM bank VC. The third pixel selected appears on DATA 0 and the third control signal B sends that pixel to VRAM bank VB. The fourth pixel selected appears on DATA 0 and the fourth control signal D sends that pixel to VRAM bank VD. Thus, the four pixel vertical line is placed in the position illustrated for the first column in FIG. 4. Bi-directional swapper 34 receives pixel data D0, data D1, data D2, and data D3. Bi-directional swapper 34 swaps data to output A; output B, output C, and output D according to the state of select terminals S0 and S1. The swapper truth table of FIG. 5 describes the relationship between the state of select terminals S0 and S1 and the outputs provided on output A, output B, output C, and output D. For example, the first row of the table shows that if S0 and S1 are both zero, then data D0 is swapped to output A, data D1 to output B, data D2 to output C, and data D3 to output D. The second row of the table shows that if S0 is zero and S1 is one, then data D2 is swapped to output A, data D3 to output B, data D0 to output C, and data D1 to output D. The third row of the table shows that if S0 is one and S1 is zero, then data D1 is swapped to output A, data D0 to output B, data D3 to output C, and data D2 to output D. Finally, the fourth row of the table shows that if S0 and S1 are both one, then data D3 is swapped to output A, data D2 to output B, data D1 to output C, and data D0 to output D. Outputs A through D of bi-directional swapper 34 drive the data inputs of VRAM banks VA through VD.

Swapper 32 functions in a similar manner, receiving CNTRL 0 through CNTRL 3 on inputs D0 through D3, and swapping the inputs to outputs A through D according to the state of select terminals S0 and S1 of swapper 32. CNTRL 0 through CNTRL 3 control the transfer of data on DATA 0 through DATA 3. Outputs A through D of swapper 32 drive CNTRL A through CNTRL D, which control data transfer to VRAM banks VA through VD. The swapper truth table of FIG. 5 describes the relationship between the state of select terminals S0 and S1 and the outputs provided on output A, output B, output C, and output D of swapper 32.

Circuit 30 stores the pixels of a vertical line into VRAM banks VA through VD in the order shown in FIG. 4. The letters A through D of FIG. 4 are used to illustrate that the first pixel, at X address 00 and Y address 00, is stored in VA. Similarly, the second pixel of a vertical line, at X address 00 and Y address 01, is stored in VC; the third pixel of the vertical line, at X address 00 and Y address 10, is stored in VB; and the fourth pixel of the vertical line, at X address 00 and Y address 11, is stored in VD. This may be appreciated by examining the reltionship between the elements of circuit 30 and the swapper truth table, both of FIG. 5.

Starting with the first pixel at X address 00 and Y address 00, the swapper truth table shows that select terminals S0 and S1 of both swapper 32 and bi-directional swapper 34 are both zero. The table shows that for bi-directional swapper 34 input D0 is swapped to output A, which is coupled to the data input in VA. The table also shows that with S0 and S1 both zero, input D0 of swapper 32 is swapped to output A of swapper 32, which drives CNTRL A of VA. Thus, it is seen that the first pixel on DATA 0 is stored in VA. With the second pixel of the vertical line at X address 00 and Y address 01, the swapper truth table shows that for both swapper 32 and bi-directional swapper 34, select terminal S0 is zero and S1 is one. The table shows that for bi-directional swapper 34 input D0 is swapped to output C, which is coupled to the data input of VC. The table also shows that input D0 of swapper 32 is swapped to output C of swapper 32, which drives CNTRL C of VC. Thus, it is seen that the second pixel on DATA 0 is stored in VC.

With the third pixel of the vertical line at X address 00 and Y address 10, the swapper truth table shows that select terminal S0 is one and S1 is zero. The table shows that for bi-directional swapper 34 input D0 is swapped to output B, which is coupled to the data input of VB. The table also shows that input D0 of swapper 32 is swapped to output B of swapper 32, which drives CNTRL B of VB. Thus, it is seen that third pixel on DATA 0 is stored in VB. For the fourth pixel at X address 00 and Y address 11, the swapper truth table shows that select terminals S0 and S1 are both one. The table shows that for bi-directional swapper 34 input D0 is swapped to output D, which is coupled to the data input of VD. The table also shows that input D0 of swapper 32 is swapped to output D of swapper 32, which drives CNTRL D of VD. Thus, it is seen that the fourth pixel on DATA 0 is stored in VD.

Additional vertical and horizontal lines may be tested using the truth table of FIG. 5, but it will be apparent that the pattern of FIG. 4 will be produced for the standard input addresses.

In a similar manner, the XOR gates 35 and 35 are furnished values from display line counter and the pixel counter and produce output values to control the multiplexor 41 so that the values sequentially furnished to the display when the multiplexor 39 is furnished lines of pixels serially arranged in accordance with the pattern of FIG. 4 will be in the regular ABCD order as in a typical frame buffer arrangement.

Thus, as may be seen, the circuit of the present invention functions to place pixel data in the pattern illustrated in FIG. 4, a pattern which allows the overlapping of accesses in writing a vertical line to the frame buffer and thus the rapid access of the frame buffer in describing vertical lines on the output display. Although it may be seen in FIG. 4 that a greater number of diagonal lines described will require sequential access of the same VRAM bank, no vertical line will do so. Because the much greater number of vertical than diagonal lines which statistically appear on a display in windowing environment, the speed of the displaying is expected to increase significantly. There is no sequence of four pixels, even on the diagonal, where there is no interleaving at all. Consequently, the performance improvement is expected to be between three and four. Thus, the remap of the chip select lines provided by this invention provides significantly better vertical line performance without giving up any horizontal performance.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. In a graphics display system having a frame buffer for storing a plurality of pixels each having an associated X address and Y address, said frame buffer arranged in a plurality of VRAM banks, each VRAM bank having a control input and data input, said frame buffer having a multiplexor and a pixel counter for sequencing data from said VRAM banks for display, a VRAM access circuit comprising:

means for selectively mapping pixel data to said VRAM banks under control of a first select;

means for selectively mapping a plurality of control signals to said control inputs of said VRAM banks under control of a second select;

counter means for generating a plurality of line signals indicating a line number for an output pixel as said output pixel is sequenced from said frame buffer; and logic means coupled to receive said line signals and to receive a plurality of pixel number signals from said pixel counter, said logic means generating a plurality of multiplexor select signals, said multiplexor select signals coupled to said multiplexor for sequencing said pixel data for display;

whereby said pixel data is selectively mapped to said VRAM banks.

2. The circuit defined by claim 1, wherein said first select and said second select are coupled to lower order bits of said Y address of said pixels.

3. In a graphics display system having a frame buffer for storing a plurality of pixels each having an associated X address and Y address, said frame buffer arranged as four VRAM banks, said frame buffer having a multiplexor and a pixel counter for sequencing data from said VRAM banks for display, a VRAM access circuit comprising:

first swapping means coupled to receive pixel data for four adjacent pixels and transfer said pixel data to said VRAM banks, said pixel data received on a first input and a second input and a third input and a fourth input which map to a first output and a second output and a third output and a fourth output according to the state of a pair of first select signals, said first output coupled to a data input of a first VRAM bank, said second output coupled to a data input of a second VRAM bank, said third output coupled to a data input of a third VRAM bank, said fourth output coupled to a data input of a fourth VRAM bank;

second swapping means coupled to receive four control signals and transfer said control signals to control inputs of said VRAM banks, said control signals received on a fifth input and a sixth input and a seventh input and an eighth input which map to a fifth output and a sixth output and a seventh output and an eighth output according to the state of a pair of second select signals, said fifth output coupled to a control input of said first VRAM bank, said sixth output coupled to a control input of said second VRAM bank, said seventh output coupled to a control input of said third VRAM bank, said eighth output coupled to a control input of said fourth VRAM bank;

counter means for generating a pair of line signals indicating a line number for an output pixel as said output pixel is sequenced from said frame buffer; and logic means coupled to receive said line signals and receive a pair of pixel number signals from said pixel counter, said logic means generating a pair of multiplexor select signals from said multiplexor;

whereby said pixel data for said four adjacent pixels is selectively mapped to said four VRAM banks.

4. The circuit defined by claim 3, wherein said first select signals comprise and S0 signal and an S1 signal such that if said S0 and S1 are both in a first state then said first input is mapped to said first output and said second input is mapped to said second output and said third input is mapped to said third output and said fourth input is mapped to said fourth output.

5. The circuit defined by claim 3, wherein said first select signals comprise an S0 signal and an S1 signal such that if said S0 is in a first state and said S1 is in a second state then said first input is mapped to said third output and said second input is mapped to said fourth output and said third input is mapped to said first output and said fourth input is mapped to said second output.

6. The circuit defined by claim 3, wherein said first select signals comprise an S0 signal and an S1 signal such that if said S0 is in a second state and said S1 is in a first state then said first input is mapped to said second output and said second input is mapped to said first output and said third input is mapped to said fourth output and said fourth input is mapped to said third output.

7. The circuit defined by claim 3, wherein said first select signals comprise an S0 signal and an S1 signal such that if said S0 and S1 are both in a second state then said first input is mapped to said fourth output and said second input is mapped to said third output and said third input is mapped to said second output and said fourth input is mapped to said first output.

8. The circuit defined by claim 3, wherein said second select signals comprise an S0 signal and an S1 signal such that if said S0 and S1 are both in a first state then said fifth input is mapped to said fifth output and said sixth input is mapped to said sixth output and said seventh input is mapped to said seventh output and said eighth input is mapped to said eighth output.

9. The circuit defined by claim 3, wherein said second select signals comprise an S0 signal and an S1 signal such that if said S0 is in a first state and said S1 is in a second state then said fifth input is mapped to said seventh output and said sixth input is mapped to said eighth output and said seventh input is mapped to said fifth output and said eighth input is mapped to said sixth output.

10. The circuit defined by claim 3, wherein said second select signals comprise an S0 signal and an S1 signal such that if said S0 is in a second state and said S1 is in a first state then said fifth input is mapped to said sixth output and said sixth input is mapped to said fifth output and said seventh input is mapped to said eighth output and said eighth input is mapped to said seventh output.

11. The circuit defined by claim 3, wherein said second select signals comprise an S0 signal and an S1 signal such that if said S0 and S1 are both in a second state then said fifth input is mapped to said eighth output and said sixth input is mapped to said seventh output and said seventh input is mapped to said sixth output and said eighth input is mapped to said fifth output.

12. The circuit defined by claim 3, wherein said first select signals comprise an S0 signal and an S1 signal, said S1 signal coupled to a least significant bit of said Y address, said S0 signal coupled to a next to least significant bit of said Y address.

13. The circuit defined by claim 3, wherein said second select signals comprise an S0 signal and an S1 signal, said S1 signal coupled to a least significant bit of said Y address, said S0 signal coupled to a next to least significant bit of said Y address.

14. In a graphics display system having a frame buffer for storing a plurality of pixel each having an associated X address and Y address, said frame buffer arranged as four VRAM banks, a method for accessing VRAM comprising the steps of:

receiving pixels data for four adjacent pixels, said pixel data comprising a first pixel, a second pixel, a third pixel, and a fourth pixel;

selectively swapping said pixel data to a first VRAM bank, a second VRAM bank, a third VRAM bank, and a fourth VRAM bank, according to the state of a first select signal and a second select signal;

receiving a first control signal, a second control signal, a third control signal, and a fourth control signal;

selectively swapping said first control signal, said second control signal, said third control signal, and said fourth control signal to a control input for said first VRAM bank, a control input for said second VRAM bank, a control input for said third VRAM bank, and a control input for said fourth VRAM bank, according to the state of said first select signal and said second select signal;

generating a pair of line signals indicating a line number for an output pixel as said output pixel is sequenced from said frame buffer; and generating a pair of pixel number signals;

reading said pixel data from said first VRAM bank, said second VRAM bank, said third VRAM bank, and said fourth VRAM bank, according to the state of said line signals and said pixel number signals;

whereby said pixel data for said four adjacent pixels is selectively mapped to said four VRAM banks.

15. The method of claim 14, wherein the step of selectively swapping said pixel data comprises the steps of:

if said first and second select signals are both in a first state, then mapping said first pixel to said first VRAM bank, said second pixel to said second VRAM bank, said third pixel to said third VRAM bank, and said fourth pixel to said fourth VRAM bank;

if said first select signal is in said first state and said second select signal is in a second state, then mapping said first pixel to said third VRAM bank, said second pixel to said fourth VRAM bank, said third pixel to said first VRAM bank, and said fourth pixel to said second VRAM bank;

if said first select signal is in said second state and said second select signal is in said first state, then mapping said first pixel to said second VRAM bank, said second pixel to said first VRAM bank, said third pixel to said fourth VRAM bank, and said fourth pixel to said third VRAM bank;

if said first and second select signals are both in said second state, then mapping said first pixel to said fourth VRAM bank, said second pixel to said third VRAM bank, said third pixel to said second VRAM bank, and said fourth pixel to said first VRAM bank.

16. The method of claim 15, wherein said first select signal is coupled to a least significant bit of said Y address, and said second select signal is coupled to a next to least significant bit of said Y address.

17. The method of claim 14, wherein the step of selectively swapping said first control signal, said second control signal, said third control signal, and said fourth control signal comprises the steps of:

if said first and second select signals are both in a first state, then mapping said first control signal to said control input for said first VRAM bank, said second control signal to said control input for said second VRAM bank, said third control signal to said control input for said third VRAM bank, and said fourth control signal to said control input for said fourth VRAM bank;

it said first select signal is in said first state and said second select signal is in a second state, then mapping said first control signal to said control input for said third VRAM bank, said second control signal to said control input for said fourth VRAM bank, said third control signal to said control input for said first VRAM bank, and said fourth control signal to said control input for said second VRAM bank;

if said first select signal is in said second state and said second select signal is in said first state, then mapping said first control signal to said control input for said second VRAM bank, said second control signal to said control input for said first VRAM bank, said third control signal to said control input for said fourth VRAM bank, and said fourth control signal to said control input for said third VRAM bank;

if said first and second select signals are both in said second state, then mapping said first control signal to said control input for said fourth VRAM bank, said second control signal to said control input for said third VRAM bank, said third control signal to said control input for said second VRAM bank, and said fourth control signal to said control input for said first VRAM bank.

18. The method of claim 17, wherein said first select signal is coupled to a least significant bit of said Y address, and said second select signal is coupled to a next to least significant bit of said Y address.

* * * * *